US008905091B2

(12) United States Patent
Galinha et al.

(10) Patent No.: US 8,905,091 B2
(45) Date of Patent: Dec. 9, 2014

(54) DEVICE FOR DISPENSING A LIQUID COSMETIC PRODUCT

(75) Inventors: Paulo Galinha, Nancy (FR); Samuel Kenzari, Andilly (FR); David Bonina, Dieulouard (FR)

(73) Assignee: Paulo Galinha, Nancy (FR)

( * ) Notice: Subject to any disclaimer, the term of this patent is extended or adjusted under 35 U.S.C. 154(b) by 782 days.

(21) Appl. No.: 13/146,980

(22) PCT Filed: Feb. 15, 2010

(86) PCT No.: PCT/FR2010/050255

§ 371 (c)(1),
(2), (4) Date: Jul. 29, 2011

(87) PCT Pub. No.: WO2010/092310

PCT Pub. Date: Aug. 19, 2010

(65) Prior Publication Data

US 2012/0018036 A1 Jan. 26, 2012

(30) Foreign Application Priority Data

Feb. 13, 2009 (FR) ..... 09 00666

(51) Int. Cl.

| | |
|---|---|
| ***B65B 1/04*** | (2006.01) |
| ***B05B 9/08*** | (2006.01) |
| ***B05B 11/00*** | (2006.01) |
| ***B65D 83/42*** | (2006.01) |
| ***A45D 34/06*** | (2006.01) |
| ***A45D 34/02*** | (2006.01) |

(52) U.S. Cl.

CPC ..... *B05B 9/0805* (2013.01); *B05B 11/0056* (2013.01); *B05B 9/0833* (2013.01); *B65D 83/42* (2013.01); *A45D 34/06* (2013.01); *A45D 34/02* (2013.01)

USPC ..... 141/349; 141/25; 141/26; 141/348

(58) Field of Classification Search

USPC ..... 141/3, 25, 26, 113, 346–349, 363–366; 222/628; 215/2

See application file for complete search history.

(56) References Cited

U.S. PATENT DOCUMENTS 3,105,104 A * 9/1963 Neiss ..... 261/64.1
3,343,718 A * 9/1967 Siegel et al. ..... 222/1

(Continued)

FOREIGN PATENT DOCUMENTS

| | | |
|---|---|---|
| EP | 1949814 | 7/2008 |
| FR | 1262580 | 6/1961 |
| GB | 2451446 | 2/2009 |

OTHER PUBLICATIONS

International Search Report dated, Sep. 9, 2009.

*Primary Examiner* — Timothy L Maust
(74) *Attorney, Agent, or Firm* — Sofer & Haroun, LLP

(57) ABSTRACT

A dispenser device (10) for dispensing a liquid cosmetic having a first bottle (12), a second bottle (14) and a first transfer means (24) for transferring the liquid from the first bottle (12) towards the second bottle (14). The first transfer means (24) has a first portion that is secured to the first bottle (12) and that is disposed in the proximity of the bottom wall, and a second portion that is secured to the second bottle (14), the first and second portions sealing their respective bottles (12, 14) when they are uncoupled. The coupling of the first portion with the second portion enables the liquid to flow between the first bottle (12) and the second bottle (14), in such a manner that, after coupling the two portions together, the first and second bottles (12, 14) present first and second pressures that tend towards equilibrium by the liquid flowing from the first bottle (12) towards the second bottle (14).

12 Claims, 4 Drawing Sheets

(56) References Cited

U.S. PATENT DOCUMENTS

| | | | | | |
|---|---|---|---|---|---|
| 3,718,165 | A * | 2/1973 | Grothoff | ..... | 141/20 |
| 4,877,065 | A * | 10/1989 | Lamboy et al. | ..... | 141/18 |
| 4,913,197 | A * | 4/1990 | Friedrich | ..... | 141/3 |
| 5,174,343 | A | 12/1992 | Rood | | |
| 5,597,019 | A * | 1/1997 | Thomas et al. | ..... | 141/18 |
| 6,116,296 | A * | 9/2000 | Turunen | ..... | 141/20 |
| 6,435,231 | B1 * | 8/2002 | Cooper et al. | ..... | 141/346 |
| 7,470,293 | B2 * | 12/2008 | Edlund et al. | ..... | 48/61 |
| 2005/0205151 | A1 | 9/2005 | Behar | | |

* cited by examiner

DEVICE FOR DISPENSING A LIQUID COSMETIC PRODUCT

RELATED APPLICATIONS

This application is a National Phase application of PCT/FR2010/050255, filed on Feb. 15, 2010, which in turn claims the benefit of priority from French Patent Application No. 09 00666, filed on Feb. 13, 2009, the entirety of which is incorporated herein by reference.

BACKGROUND

1. Field of the Invention

The present invention relates to "travel" or "nomad" dispenser devices for dispensing liquid cosmetics, in particular between a main bottle and a refillable bottle.

More particularly, it relates to a dispenser device for dispensing a liquid cosmetic, said device comprising: a first bottle that is defined, in part, by a bottom wall, and that contains a first initial volume of liquid cosmetic that is under a volume of gas that presents a first initial pressure, the first bottle including, in its top portion, a spray valve; a second bottle that includes, in its top portion, a spray valve, and that contains a second initial volume of liquid that is under a second volume of gas that presents a second initial pressure; and transfer means for transferring the liquid from the first bottle towards the second bottle.

2. Description of Related Art

Document EP 1 919 814 describes a cosmetic spray that is refillable. To this end, the spray includes a filling nozzle that is fitted with a threaded plug that includes an orifice for expelling compressed air that is situated in the spray. However, that document does not describe a dispenser device for dispensing a cosmetic between two bottles in which the device presents a limited number of gas and liquid inlets and outlets, and consequently does not face the problems of making a bottle that is attractive and that is easy to use in order to refill it.

Document FR 2 867 761 describes a cosmetic-dispenser refill device that makes it possible to refill a container by gravity by disposing the refill above the container. However, that system requires a leaktight membrane no be pierced in non-reversible manner, which may lead to the cosmetic contained in the refill being spoilt if the refill is not emptied completely. In addition, reusing the refill is complicated, and the user risks spilling the cosmetic as a result of the sealing membrane being absent.

OBJECTS AND SUMMARY

The object of the present invention is to mitigate those drawbacks and to propose a liquid-cosmetic dispenser device that, in non-limiting manner, may be used several times, and that is simple for the user to use.

The invention thus provides a dispenser device for dispensing a liquid cosmetic, said device comprising:

- a first bottle that is defined, in part, by a bottom wall, and that contains a first initial volume of liquid cosmetic that is under a volume of gas that presents a first initial pressure, the first bottle including, in its top portion, a spray valve;
- a second bottle that includes, in its top portion, a spray valve, and that contains a second, possibly zero, initial volume of liquid that is under a second volume of gas that presents a second initial pressure; and

- first transfer means for transferring the liquid from the first bottle towards the second bottle.

In accordance with the invention, the first transfer means comprise a first portion that is secured to the first bottle and, by way of example, is disposed in the bottom half of the first bottle, e.g. in the proximity of the bottom wall, and in particular above said bottom wall, and a second portion that is secured to the second bottle, the first and second portions sealing their respective bottles when they are uncoupled, and the coupling of the first portion with the second portion enables the liquid to flow between the first bottle and the second bottle, in such a manner that, after coupling the two portions together, the first and second bottles present first and second pressures that tend towards equilibrium by the liquid flowing from the first bottle towards the second bottle.

The term "tend towards equilibrium" means pressures having values that tend to become equal. In addition, the term "initial" means the pressures and the volumes present in the bottles prior to the two bottles being coupled together, after the spray valve has been operated at least once.

By means of these provisions, the liquid dispenser device is simple for the user to use, and avoids any leakage of liquid between the first and second bottles.

In a first embodiment, the first bottle is provided with a spray valve that enables air to be admitted at atmospheric pressure into the first bottle on each spraying, and the second bottle includes a spray valve that prevents any air from being admitted into the second bottle, so that, after spraying, the second initial pressure is less than the first initial pressure.

In a second embodiment, the first bottle includes means of pressurizing the internal, volume of the bottle, so that the first initial pressure of the first bottle is greater than the second initial pressure of the second bottle.

Pressurizing may be achieved by emitting an inert gas into the first bottle.

The gas may be contained in a gas cartridge that is adjacent to the first bottle, and that is connected in leaktiqht manner to the first bottle.

In a third embodiment, the device includes second transfer means including a tube making it possible to couple the volume of gas of the first bottle to the volume of gas of the second bottle.

In a fourth embodiment, the first and second bottles include means that make it possible to put the volume of gas under atmospheric pressure after coupling the first and second portions of the transfer means.

In a fifth embodiment, the device includes second transfer means that are capable of connecting the volume of gas of the second bottle to the volume of liquid of the first bottle, the first transfer means leading to the second bottle at a level that is lower than the level at which the first transfer means lead to the second bottle, so as to enable liquid to be transferred from the first bottle towards the second bottle, and simultaneously gas to be transferred from the second bottle towards the liquid of the first bottle.

The first and second transfer means lead to the first bottle preferably at substantially the same level, i.e. they open out at levels that are substantially in horizontal alignment, preferably at the same level, at a level that is possibly situated in the vicinity of the bottom wall of the first bottle, and preferably in the bottom wall of the first bottle.

In this fifth embodiment, the first and second transfer means may be disposed in a part that is distinct from the first and second bottles, said part being capable of being coupled to the first and second bottles and of being uncoupled therefrom.

The device in any one of the first three embodiments or in the fifth embodiment advantageously constitutes a closed circuit.

The second bottle may present dimensions that are smaller than the dimensions of the first bottle.

The first and second bottles extend between respective bottom and top ends, and the bottom wall of the first bottle may be disposed at a distance from the bottom end of the first bottle, which distance corresponds substantially to the height of the second bottle.

BRIEF DESCRIPTION OF THE DRAWINGS

Other characteristics and advantages of the present invention appear more clearly on reading the following description, given by way of illustrative and non limiting example, and with reference to the accompanying drawings, in which.

DETAILED DESCRIPTION

Figure 1A:
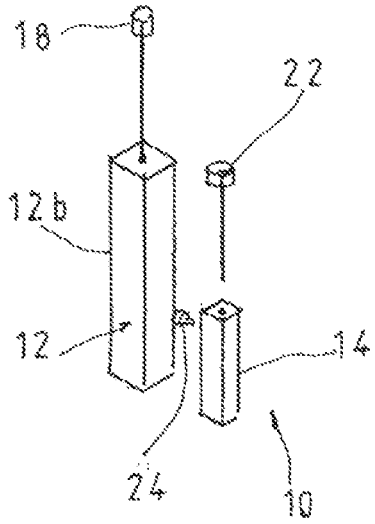
FIGS. 1A, 1B, and 1C are an exploded perspective view, a side view, and a plan view respectively of a first embodiment of the invention.

The present invention relates to sprays or atomizers for spraying a liquid cosmetic, such as fragrance, or any other are product for the human body. It relates more particularly to sprays or atomizers that are formed by a bottle that is provided, at its top end, with a spray valve or pump, making it possible to spray the liquid cosmetic out from the bottle merely by pressing on the pump or the spray valve.

The dispenser device 10 of the invention includes a first bottle 12 and a second bottle 14 containing the liquid cosmetic. The first bottle 12 includes a bottom wall 12*a* and longitudinal walls 12*b* that define a storage reservoir that is adapted to contain the liquid. The first bottle 12 further includes a spray valve 18 of the above-mentioned type.

Prior to first use, the first bottle 12 contains a first defined initialization volume V1L of liquid that is under a second defined initialization volume V1G of gas.

Like the first bottle 12, the second bottle 14 presents longitudinal walls 14*b* and a bottom wall 14*a* that define a storage reservoir 20 for storing the liquid to be sprayed by means of a spray valve 22. Prior to first use, the second bottle 14 contains a defined initialization volume V2L of liquid that is under a defined initialization volume V2G of gas.

The initialization volumes V1L and V2L of liquid may be emptied merely by pressing on the spray pump 18, 22.

Figure 5A:
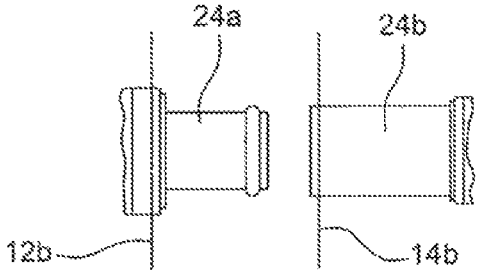
FIGS. 5A and 5B show the first transfer means in their released position and in their coupled position respectively.
Figure 5B:
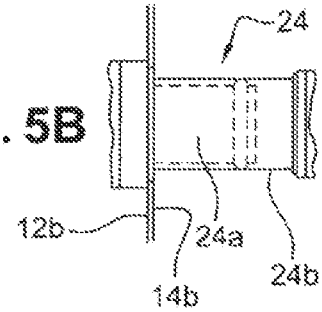

The storage reservoirs 16 and 20 are put into communication by means of transfer means 24 that are adapted to enable the liquid to flow between the two bottles 12 and 14 in leaktight manner. To this end, the transfer means 24 are formed by a quick coupler comprising first and second portions 24*a* and 24*b* that are adapted to be coupled together, the coupler presenting automatic closure of the first and second portions 24*a* and 24*b* on being uncoupled. In addition, the coupler is selected so as to enable the user to couple or to uncouple the first and second portions 24*a* and 24*b* without a specific tool, without admitting air, and without losing any liquid. FIG. 5A shows the coupler in its uncoupled position, and FIG. 5B shows the coupler in its coupled position.

The first portion 24*a* of the transfer means 24 is disposed in the proximity of the bottom wall 12*a* of the first bottle 12, in such a manner that the entire volume of liquid is disposed above the first portion 24*a*, i.e. practically all of the volume of liquid of the bottle 12 can flow towards the second bottle 14.

In a variant, provision may be made for the bottom wall 12*a*, and consequently the first portion 24*a*, to be positioned at a certain height that corresponds to the height of the second bottle 14, so that all of the liquid disposed above the first portion 24*a* can flow towards the second bottle 14 until it is full.

Various embodiments are described below. For each embodiment, the various initialization conditions are specified for the pressure in the first and second bottles 12 and 14, in order to enable the liquid to flow from the first bottle 12 towards to second bottle 14.

Figure 1B:
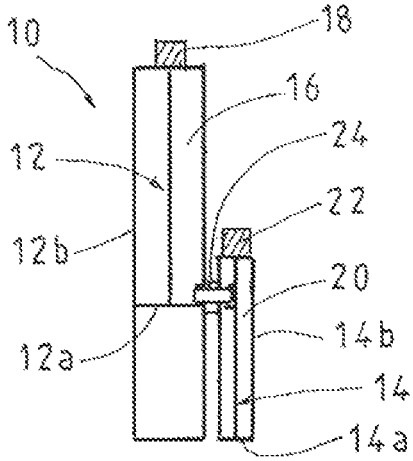
Figure 1C:
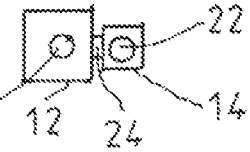

In a first embodiment, shown in FIGS. 1A to 1C, the first bottle 12 and the second bottle 14 are filled with liquids, and prior to any use, they present respective volumes V1L and V2L of liquid, and pressures P1G and P2G of gas, which pressures are equal to atmospheric pressure.

The spray valve 18 of the first bottle 12 is made in such a manner that after each spraying, air is admitted into the first bottle 12. Thus, after use, and prior to any coupling with the second bottle 14, the first bottle 12 presents an initial volume V1'L of liquid that is smaller than the initialization volume V1L, and presents an initial volume V1'G of gas in the form of air under atmospheric pressure P1'G.

The spray valve 22 of the second bottle 14 is formed in such a manner that after spraying, no volume of air is admitted into the second bottle 14. As a result, after at least one spraying, the second bottle 14 presents a volume V2'L of liquid that is smaller than the initialization volume V2L contained prior to the device being used, and a volume V2'G of gas that presents a pressure P2'G that is lower than the initialization pressure P2G, and consequently lower than the pressure P1'G.

When the first bottle 12 and the second bottle 14 are coupled together by means of the leaktight transfer means 24, as described above, the suction that exists in the second bottle 14 causes liquid to flow from the first bottle 12 towards the second bottle 14, in such a manner as to equalize the pressures.

Thus, after coupling, the first bottle 12 presents a pressure P1"G of gas that is lower than the initial pressure P1'G, and the second bottle 14 presents a pressure P2"G of gas that is higher than the initial pressure P2'G prior to coupling.

After coupling, so long as the pressure of the gas in the second bottle 14 is lower than the pressure of the gas in the first bottle 12, i.e. while P2"G is lower than P1"G, the device tends to cause the liquid to flow towards the second bottle 14 until the pressures P2"G and P1"G are equal, or until the second bottle 14 is full of liquid.

After filling the second bottle 14, the user uncouples the second portion 24*b* of the transfer means 24 from the first portion 24*a*. As mentioned above, uncoupling the first and second portions 24*a* and 24*b* causes said first and second portions to close automatically, in such a manner that the first and second bottles 12 and 14 are completely leaktiqht.

After emptying the bottle of its contents by means of the spray pump 22, the user may once again refill the second bottle 14 by coupling it to the first bottle 12, the liquid flowing from the first bottle 12 towards the second bottle 14 by means of the pressure difference that exists between the two bottles 12 and 14.

In a second embodiment, the first bottle 12 includes means for pressurizing the internal volume of the bottle 12, in such a manner that the first initial pressure P1'G of gas of the first bottle 12 is greater than the second initial, pressure P2'G of gas of the second bottle 14.

Figure 2A:
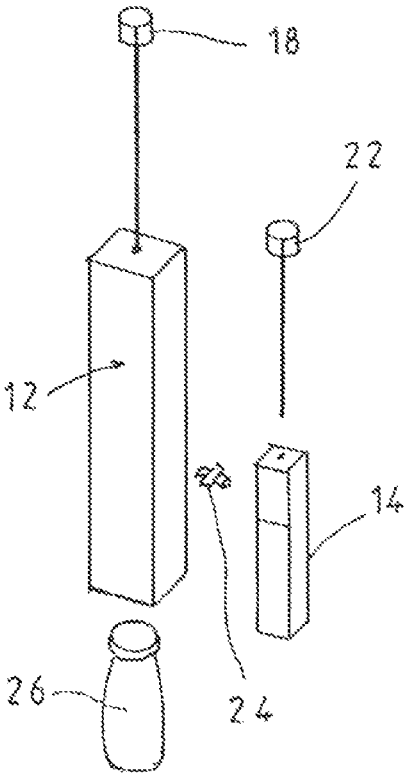
FIGS. 2A to 2C and 3A to 3C are views similar to the views in FIGS. 1A to 1C showing second and third embodiments.
Figure 2B:
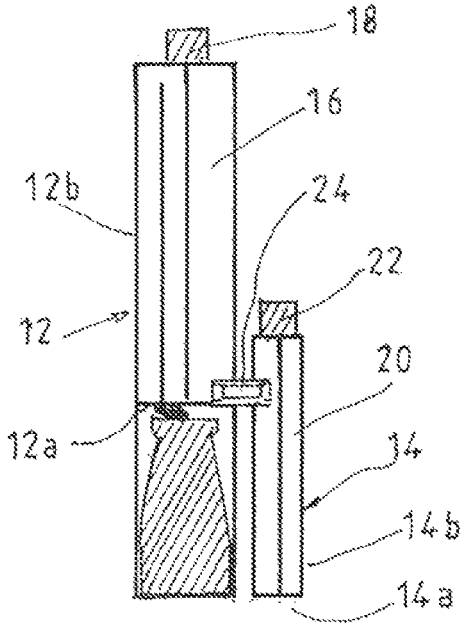
Figure 2C:
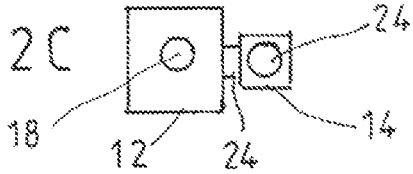

As shown in FIGS. 2A to 2C, the first initial pressure P1'G is raised relative to the initialization pressure P1G by emitting a gas into the first bottle 12. The selected gas is inert, i.e. not harmful to health, so that it does not react with the liquid contained in the first bottle 12. The selected gas may be argon, nitrogen, or any other chemically inactive gas known to the person skilled in the art.

The gas is contained in a gas cartridge 26 that is disposed adjacent to the first bottle 12. As shown in FIG. 2B, the gas cartridge 26 is disposed under the bottom wall 12*a* of the first bottle 12.

The cartridge 26 is connected in leaktight manner to the first bottle 12, in such a manner that the gas can be injected into the first bottle 12 without any leakage of said gas or of the liquid contained in said first bottle 12.

The inert gas is diffused automatically by means of the as cartridge 26, until the pressure of the gas inside the first bottle 12 reaches a determined value that is higher than atmospheric pressure.

The second bottle 14 includes, a pump allowing air to be admitted at atmospheric pressure after each press, such that after the pump has been pressed, the gas contained in the second bottle 14 presents a pressure P2'G that is substantially equal to atmospheric pressure.

Prior to coupling the two bottles 12 and 14 together, the pressure P1'G is higher than the pressure P2'G. When the two bottles 12 and 14 are coupled together, the two pressures are different and tend to equalize, and consequently the liquid contained in the first bottle 12 flows towards the second bottle 14.

Figure 3A:
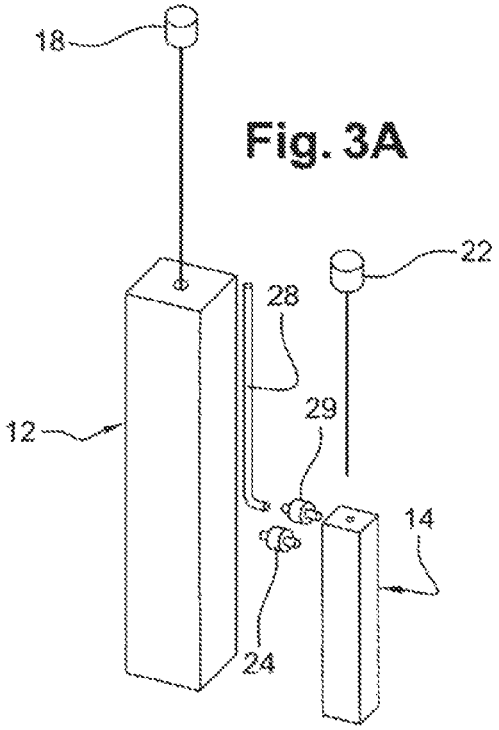
Figure 3B:
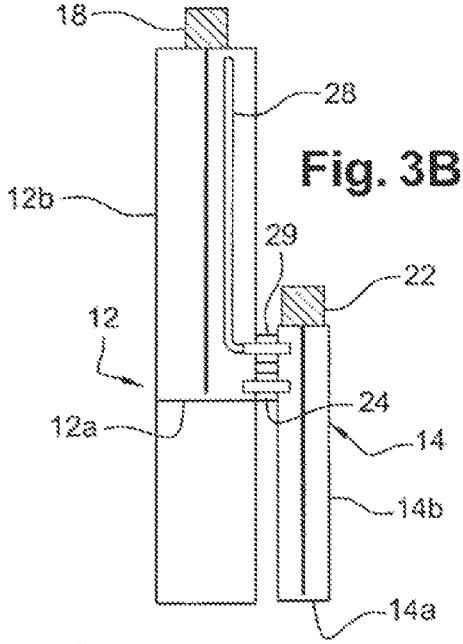
Figure 3C:
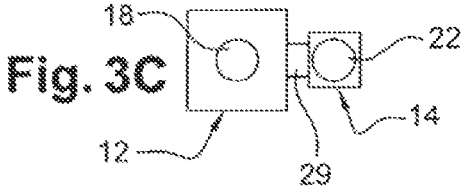

In a third embodiment, shown in FIGS. 3A to 3C, the dispenser device further includes second transfer means that are used to connect together the gas volumes of the two bottles 12 and 14. The second transfer means comprise a tube 28 and a second coupler 29, the tube 28 leading firstly to the first volume of as of the reservoir 16 of the first bottle 12, and secondly to a male portion of the second coupler 29 leading to the outside of the first bottle 12. The second bottle 14 includes a female portion of the second coupler, so as to enable the tube 28 to be inserted into the volume of gas of the second bottle 14 without any risk of gas leaking. Each of the ends of the tube 28 leads to the top portion of a respective one of the first and second bottles 14, i.e. to the portions in which the gas is situated.

The above-described arrangement makes it possible, when the first and second bottles 12 and 14 are coupled together, i.e. when the first and second portions 24*a* and 24*b* of the transfer means 24 are coupled together, and when the tube 28 is inserted into the first and second bottles 12 and 14, to obtain a "communicating vase" system. The liquid present in the first and second bottles 12 and 14 that are interconnected at their bases by the transfer means 24, tends to present the same level, i.e. tends to present the same height relative to the support on which the bottles 12 and 14 are standing.

In order to enable a maximum flow from the first bottle 12 towards the second bottle 14, the bottom wall 12*a* of the first bottle 12 is disposed at a height that is substantially equal to the height of the second bottle 14. A closed circuit is created in which the pressures equalize continuously during refilling.

Figure 4:
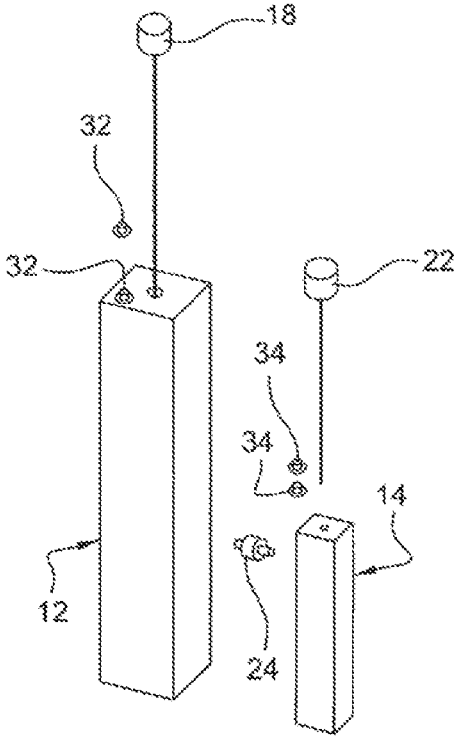
FIG. 4 shows an exploded perspective view of a fourth embodiment.

In a fourth embodiment, shown in FIG. 4, the bottles 12 and 14 include means that make it possible to put the volume of gas under atmospheric pressure after coupling together the first and second portions of the transfer means 24. To this end, each bottle 12, 14 includes a respective pushbutton 32, 34 that is movable between a closed position and an open position, enabling air to be admitted at atmospheric pressure into the bottles 12 and 14.

Since the pressures P1'G and P2'G are equal to atmospheric pressure, the liquid contained in the first bottle 12 flows towards the second bottle 14 until the difference in the level of the liquid between the two bottles 12 and 14 is zero. In order that a maximum amount of liquid flows between the first and second bottles 12 and 14, the first bottle 12 is made so that the volume of liquid of the first bottle 12 is disposed above the volume of liquid of the second bottle 14. To this end, the bottom wall 12*a* of the first bottle 12 is higher than the bottom wall 14*a* of the second bottle 14.

In a variant, the means that make it possible to put the gas under atmospheric pressure are constituted by spray pumps 18 and 22 that are releasably mounted by screw fastening. Thus, after coupling the first and second bottles 12 and 14 together, the user may unscrew each pump 18, 22 with a view to putting the gas under atmospheric pressure in each bottle 12, 14. The device thus functions in the manner described above.

Figure 6A:
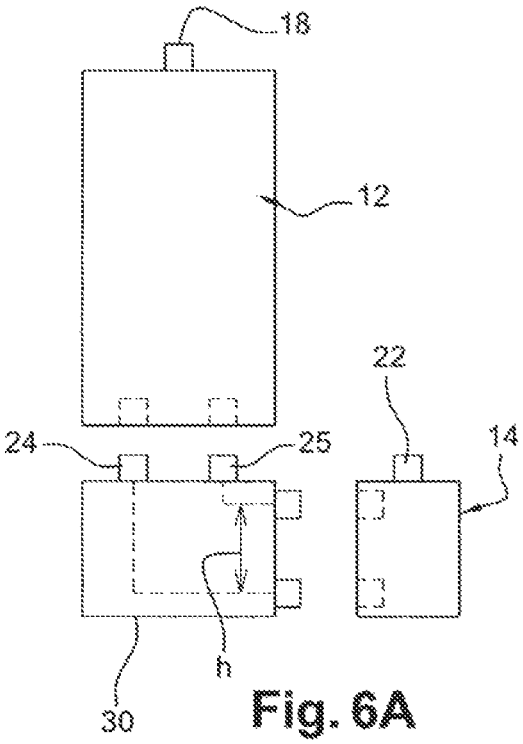
FIGS. 6A to 6E show a fifth embodiment.

In a fifth embodiment, as shown in FIG. 6A, a two-function leaktight coupler 30 is used. The coupler 30 includes a first duct 24 enabling the liquid to flow from the first bottle 12 towards the second bottle 14, and a duct 25 enabling the volume of gas under higher pressure in the second bottle 14 to pass simultaneously towards the first bottle 12. Thus, the first and second transfer means 24 and 25 pass via a part 30 that is distinct from the first and second bottles 12 and 14. The higher pressure is generated by the increase in the volume of liquid in the second bottle 14, which is non-deformable.

The ducts 24 and 25 may be connected to the first bottle 12 and to the second bottle 14 by means of quick couplers, e.g. by means of male/female type contacts.

The first duct 24 leads to the bottom portion of the second bottle 14, at a level that is lower than the level at which the second duct 25 leads to the second bottle 14. The second duct 25 leads to the top portion of the second bottle 14. The two levels are separated by a vertical height h.

The first duct 24 and the second duct 25 lead to the first bottle 12 at substantially the same level. They are thus substantially in horizontal alignment. The first duct 24 and the second duct 25 preferably lead to the bottom portion of the first bottle 12, and in particular via the bottom wall of the first bottle 12.

Figure 6B:
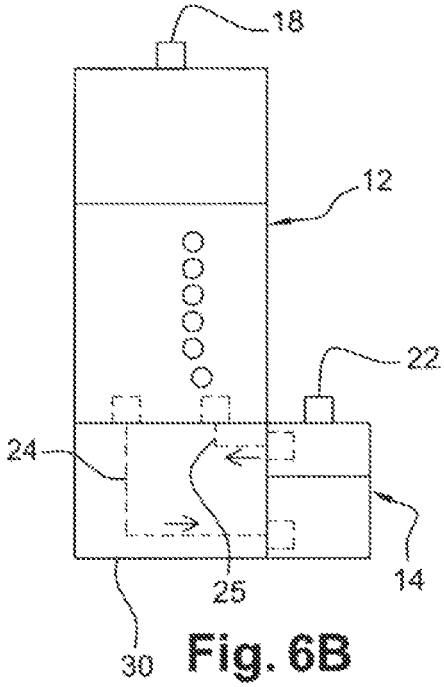

Since the hydrostatic pressure is a function that is proportional to the height h, it is greater in the first duct 24. Thus, the flow passes via the bottom of the coupler 30, and the increased pressure generated in the second bottle 14 is expelled towards the first bottle 12 via the second duct 25. In the refilling position, as shown in FIG. 6B, the pressures equalize by the gas delivered by the second duct 25 bubbling into the liquid of the first bottle 12.

Figure 6C:
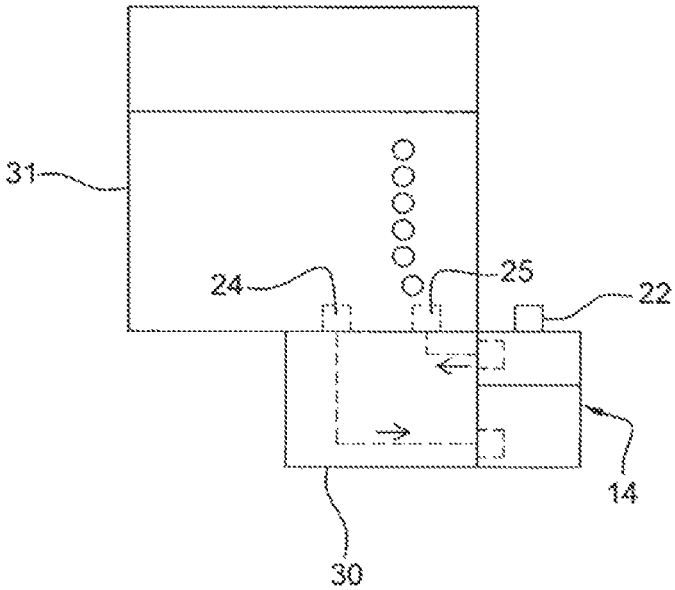
Figure 6D:
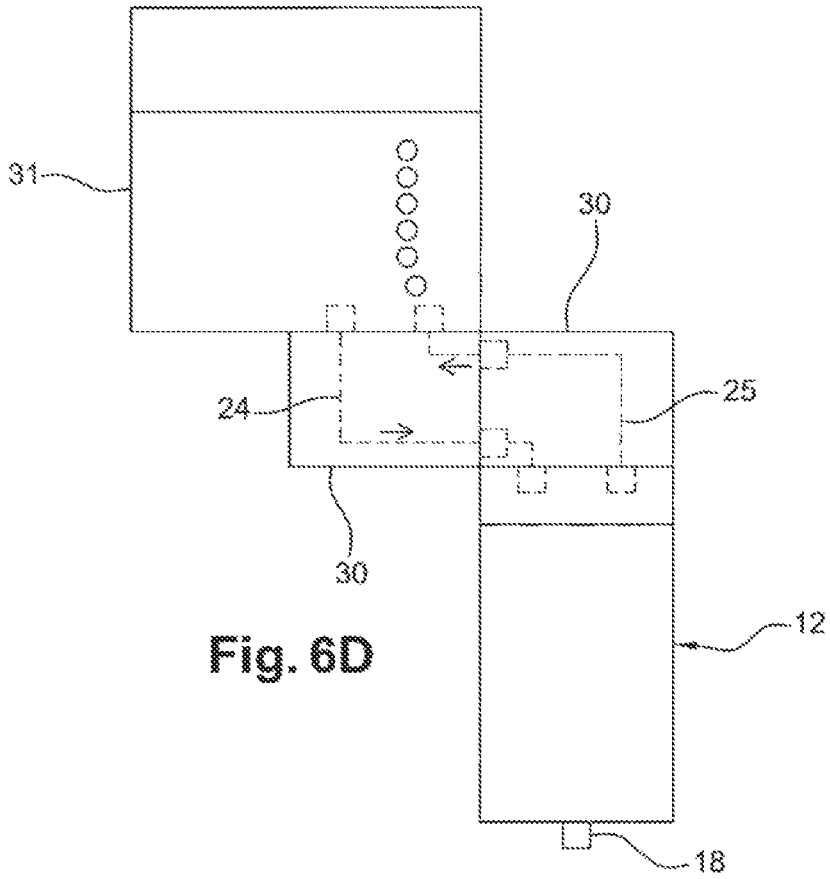
Figure 6E:
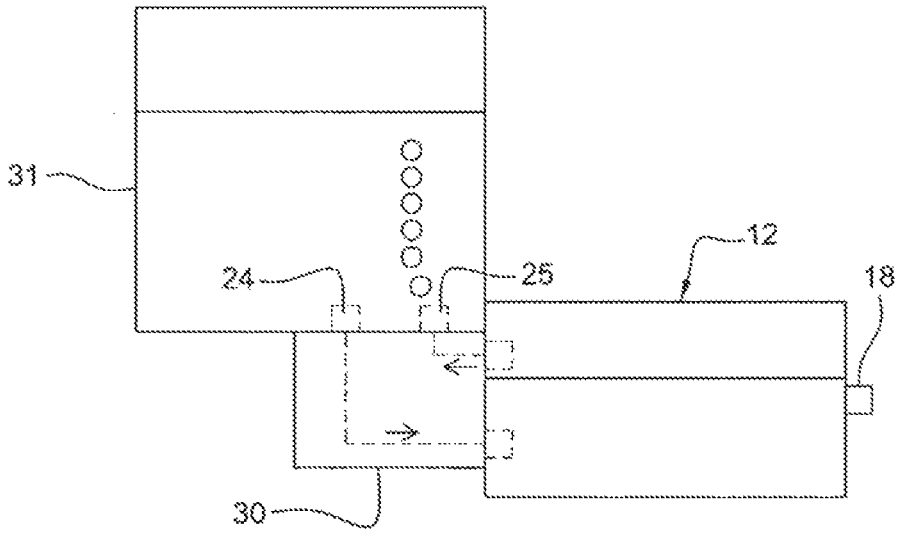

This coupling system leads to flexibility in the use of the bottles 12 and 14, and also enables the bottles 12 and 14 to be refilled from a reservoir. FIGS. 6C to 6E thus show various methods of refilling the bottles 12 and 14 from a reservoir 31.

FIG. 6C shows the second bottle 14 being refilled from a reservoir 31, by means of the coupler 30. The bottle 14 is refilled completely, identically to it being refilled from the first bottle 12.

The reservoir 31 may also refill the first bottle 12, disposed vertically, by means of two couplers 30, as shown in FIG. 6D. The first bottle 12 may thus be filled completely.

It is also possible so use only a single coupler 30 for refilling the first bottle 12 while it is disposed horizontally (FIG. 6E).

The invention claimed is:

1. A dispenser device for dispensing a liquid cosmetic, said device comprising:

a first bottle that is defined, in part, by a bottom wall, and that contains a first initial volume of liquid cosmetic that is under a volume of gas that presents a first initial pressure, the first bottle including, in its top portion, a spray valve;

a second bottle that includes, in its top portion, a spray valve, and that contains a second initial volume of liquid that is under a second volume of gas that presents a second initial pressure; and first transfer means for transferring the liquid from the first bottle towards the second bottle;

wherein the first transfer means has a first portion that is secured to the first bottle and that is disposed in the proximity of the bottom wall, and a second portion that is secured to the second bottle, the first and second portions sealing their respective bottles when they are uncoupled, and in that the coupling of the first portion with the second portion enables the liquid to flow between the first bottle and the second bottle, in such a manner that, after coupling the two portions together, the first and second bottles present first and second pressures that tend towards equilibrium by the liquid flowing from the first bottle towards the second bottle.

2. A device according to claim 1, the first bottle is provided with a spray valve that enables air to be admitted at atmospheric pressure into the first bottle on each spraying, and in that the second bottle includes a spray valve that prevents any air from being admitted into the second bottle, so that, after spraying, the second initial pressure is less than the first initial pressure.

3. A device according to claim 1, wherein the first bottle includes means of pressurizing the internal volume of the bottle, so that the first initial pressure of the first bottle is greater than the second initial pressure of the second bottle.

4. A device according to claim 3, wherein pressurizing is achieved by emitting an inert gas into the first bottle.

5. A device according to claim 4, the gas is contained in a gas cartridge that is adjacent to the first bottle, and that is connected in leaktight manner to the first bottle.

6. A device according to claim 1, wherein said device includes second transfer means including a tube making it possible to couple the volume of gas of the first bottle to the volume of gas of the second bottle.

7. A device according to claim 1, wherein the first and second bottles include means that make it possible to put the volume of gas under atmospheric pressure after coupling the first and second portions of the first transfer means.

8. A device according to claim 1, wherein said device includes second transfer means that are capable of connecting the volume of gas of the second bottle to the volume of liquid of the first bottle, the second transfer means leading to the second bottle at a level that is higher than the level at which the first transfer means leads to the second bottle, so as to enable liquid to be transferred from the first bottle towards the second bottle, and simultaneously gas to be transferred from the second bottle towards the liquid of the first bottle.

9. A device according to claim 8, wherein the first and second transfer means lead to the first bottle at substantially the same level.

10. A device according to claim 8, wherein the first and second transfer means are disposed in apart that is distinct from the first and second bottles, said part being capable of being coupled to the first and second bottles and of being uncoupled therefrom.

11. A device according to claim 1, wherein the second bottle presents dimensions that are smaller than the dimensions of the first bottle.

12. A device according to claim 11, wherein the first and second bottles extend between respective bottom and top ends, and the bottom wall of the first bottle is disposed at a distance from the bottom end of the first bottle, which distance corresponds substantially to the height of the second bottle.

* * * * *

UNITED STATES PATENT AND TRADEMARK OFFICE

CERTIFICATE OF CORRECTION

PATENT NO. : 8,905,091 B2
APPLICATION NO. : 13/146980
DATED : December 9, 2014
INVENTOR(S) : Galinha et al.

It is certified that error appears in the above-identified patent and that said Letters Patent is hereby corrected as shown below:

In the Claims

Column 8, Claim 10, Line 27: The word "apart" between the words "in" and "that" should read as: "in a part"

Signed and Sealed this
Tenth Day of March, 2015

Michelle K. Lee

Michelle K. Lee
*Deputy Director of the United States Patent and Trademark Office*